US005351597A

United States Patent [19]

Holmström et al.

[11] Patent Number: 5,351,597

[45] Date of Patent: Oct. 4, 1994

[54] ARRANGEMENT WITH RELEASE SYSTEM, AMMUNITION UNIT AND RELEASE SYSTEM

[75] Inventors: Peter Holmström, Lidingö ; Björn Levison, Kista, both of Sweden

[73] Assignee: NobelTech Electronics AB, Jarfalla, Sweden

[21] Appl. No.: 4,243

[22] Filed: Jan. 14, 1993

[30] Foreign Application Priority Data

Jan. 16, 1992 [SE] Sweden ..... 9200122-1

[51] Int. Cl.[5] ..... B64D 1/04; F42B 12/02

[52] U.S. Cl. ..... 89/6.5; 89/1.51; 89/1.56; 89/1.814; 102/206

[58] Field of Search ..... 89/6, 6.5, 1.51, 1.56, 89/1.6, 1.814; 102/200, 206, 215, 217

[56] References Cited

U.S. PATENT DOCUMENTS

| | | | |
|---|---|---|---|
| 3,499,363 | 3/1970 | Lauro | 89/1.51 |
| 3,598,015 | 8/1971 | Delistovich et al. | 89/1.814 |
| 3,735,668 | 5/1973 | Langlois et al. | 89/1.814 |
| 3,779,129 | 12/1973 | Lauro | 89/1.56 |
| 3,803,974 | 4/1974 | Everest et al. | 89/1.56 |
| 3,814,017 | 6/1974 | Backstein et al. | 89/6.5 |
| 4,068,556 | 1/1978 | Foley | 89/1.814 |
| 4,103,585 | 8/1978 | Foley | 102/215 |
| 4,359,926 | 11/1982 | Sano et al. | 89/1.814 |
| 5,034,686 | 7/1991 | Aspelin | 102/206 |

FOREIGN PATENT DOCUMENTS

| | | |
|---|---|---|
| 0282394B1 | 1/1988 | European Pat. Off. . |
| 3830903 | 3/1990 | Fed. Rep. of Germany . |
| 7414669-7 | 9/1974 | Sweden . |

*Primary Examiner*—David H. Brown

*Attorney, Agent, or Firm*—Pollock, Vande Sande & Priddy

[57] ABSTRACT

A device for indicating the type of ammunition provided in or on the ammunition unit comprises a distinguishable specific identification allocated for each type of ammunition and made up of electronic device with different electrical characteristics depending on the type of ammunition, including a status-changing element which can change between at least two statuses having different electrical characteristics. A control circuit is provided for controlling change-over of the status-changing element between the at least two statuses having different electrical characteristics, the process of the status changes controlled by the control circuit being indicative of the type of ammunition contained in the ammunition unit.

11 Claims, 2 Drawing Sheets

FIG. 1
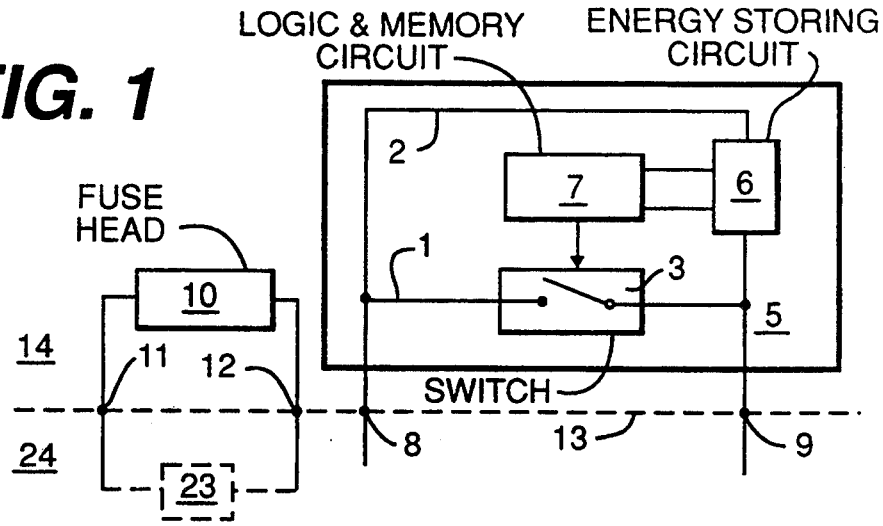
FIG. 2
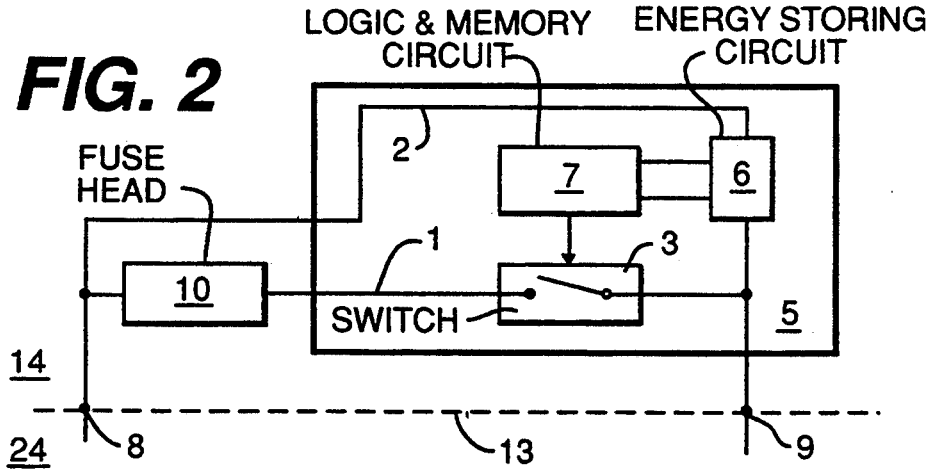
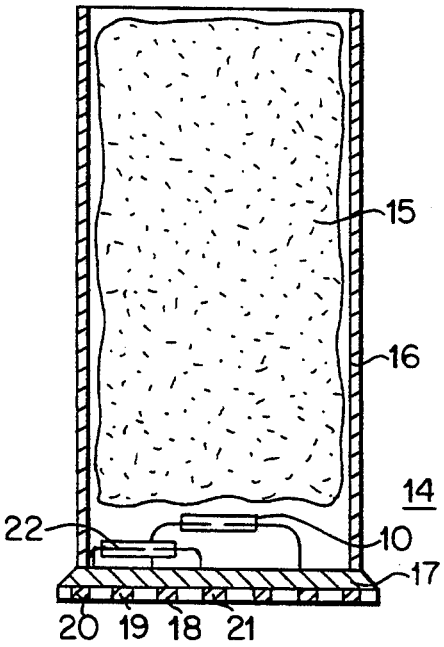
FIG. 3A
FIG. 3B
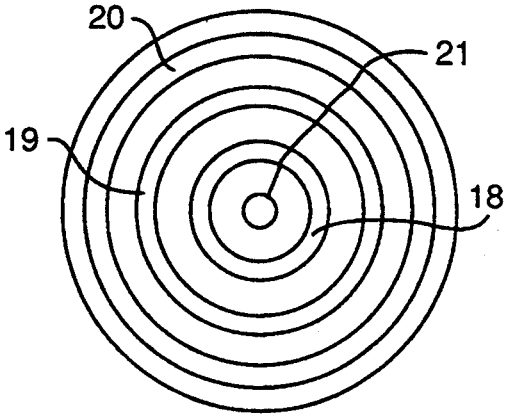

ARRANGEMENT WITH RELEASE SYSTEM, AMMUNITION UNIT AND RELEASE SYSTEM

FIELD OF THE INVENTION

The present invention relates to a device in a release system intended to be attached on or in an ammunition unit for indicating the type of ammunition which the ammunition unit contains. Each ammunition type is allocated a distinguishable specific indication means which is made up of electronic means with different electrical characteristics depending on the type of ammunition. The present invention also relates to an ammunition unit with a device according to the above, and a release system with such ammunition units. The ammunition unit comprises a number of ammunition charges, means for activation of the ammunition charges and a device according to the above for indicating the type of ammunition which the ammunition unit contains. The release system comprises at least one release unit with magazine for a number of ammunition units according to the above and a control unit for coupling electrical current to the ammunition units.

BACKGROUND OF THE INVENTION

Known devices for indicating the ammunition type can consists of color marking of the ammunition units, preferably in connection with the electrical connection at the bottom of the ammunition unit. The color marking makes it possible, for example, for flares to be distinguished from radar chaff and different types of flares or radar chaff charges can be similarly distinguished from one another. On loading the release system release units with ammunition units, the operator must make sure that the different ammunition units reach the intended place in the magazine of the release unit on the basis of the color marking. The places are predetermined. Since the loading must often be carried out under time pressure and difficult external conditions such as darkness, there is a risk of mistaking the ammunition types. The predetermined distribution of the ammunition types also involves limits in the possibilities of matching the ammunition to the prevailing threat situation.

Another device for indicating the ammunition type is known from U.S. Pat. No. 4,068,556. This device is intended for rockets and each specific type of rocket is allocated an identification impedance identifying the rocket type.

SUMMARY OF THE INVENTION

The aim of the present invention is to provide a more reliable and more flexible release system. This is achieved by use of an ammunition-indicating arrangement which is characterized in that the electronic means comprises a status-changing element which can change over between at least two statuses with different electrical characteristics and the status changes of which are indicative of the type of ammunition in question, an ammunition unit with such an ammunition-indicating device, and a release system for ammunition units according to the invention. The release system is characterized in that a measuring circuit is arranged to sense the status changes of the status-changing element for the associate ammunition units in order to determine the type of ammunition.

The present invention makes it possible for a number of types of ammunition to be mixed arbitrarily in a magazine of a release unit in a manner which is not specified in advance. The identification of the type of ammunition and its positions is first carried out when the ammunition is located in position in the magazine of the release units. On the command to release a certain type of ammunition, the release system addresses positions for this type of ammunition and at the same time the addressed positions are marked as positions in which ammunition has been used. If desired, the ammunition status can be determined again by a repeated identification operation.

According to a preferred embodiment of an ammunition type-indicating device the status changes can be initiated by external electrical influence.

According to another preferred embodiment of an ammunition type-indicating device, the number of status change-overs following initiation of the status-changing element indicates the ammunition type.

According to a further preferred embodiment, the number of status change-overs from a first status to a second status following the initiation of the status-changing element indicates the ammunition type.

The different electrical characteristics are advantageously produced by changing impedance.

According to an advantageous embodiment of the ammunition unit, the ammunition type-indicating device is connected at the same contact points as the means for activating the ammunition charges. This embodiment makes it possible to use the same relatively weak current which is connected for controlling the means for activating the ammunition charges, also for identifying the ammunition.

According to another embodiment of the present invention ammunition unit, the ammunition charges are arranged in a cartridge which has a bottom plate with connecting elements in the form of connecting rings and possibly a central connection surface for external electrical connection of the ammunition unit. The ammunition type-indicating device is connected between two of the connecting elements, that is between two rings or one ring and the central connection surface. By utilizing a cartridge of a known design, see SE C 7414669-7, the ammunition type-indicating device can be easily connected to the release system.

According to one embodiment of the release system, a measuring circuit is arranged for sensing the status changes of the status-changing element for the incoming ammunition units in order to determine the type of ammunition. The number of status change-overs or change-overs of a certain type detected by the measuring circuit indicates the ammunition type.

The invention will be described in greater detail below with reference to the attached drawings, in which:

BRIEF DESCRIPTION OF THE DRAWINGS

FIG. 1 shows in a basic diagram form a first embodiment of a present invention device for indicating the type of ammunition;

FIG. 2 shows in a basic diagram form a modification of the embodiment shown in FIG. 1;

FIG. 3*a* shows a cross-section and FIG. 3*b* shows a bottom view of an example of an ammunition unit according to the present invention;

DETAILED DESCRIPTION OF THE PREFERRED EMBODIMENT(S)

Figure 4:
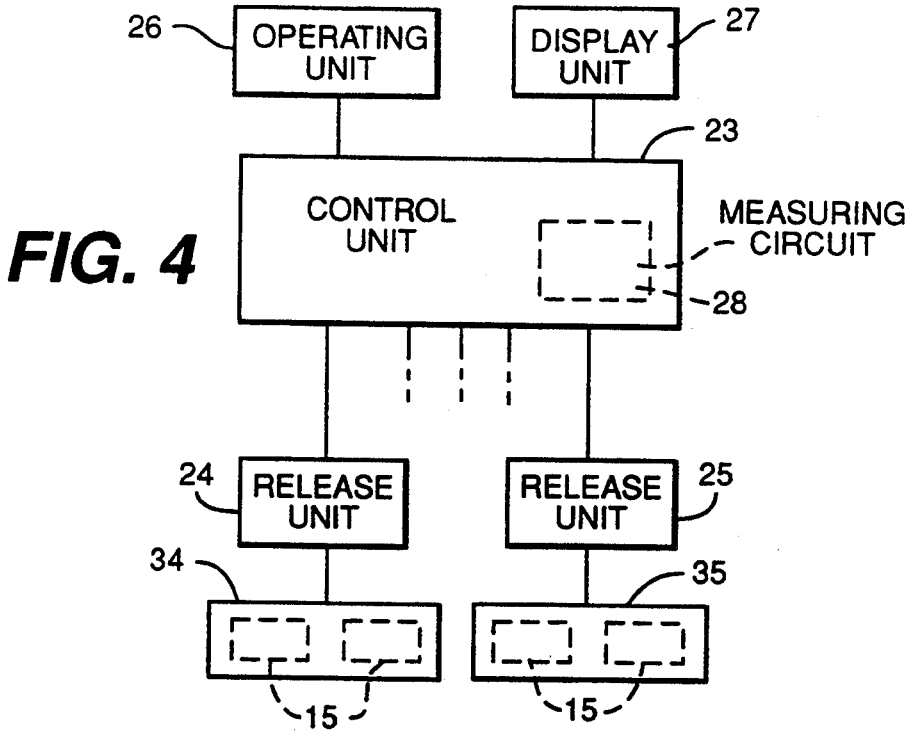
FIG. 4 shows in a basic diagram form an example of a release system adapted for ammunition units with device for indicating the type of ammunition.

The device for indicating the type of ammunition shown in FIG. 1 is constructed of two parallel branches 1, 2. One branch 1 contains a switch 3. The switch 3 can be arranged to be either normally closed or normally open in its initial position. In the other branch 2, an energy storing circuit 6 in the form of, for example, a capacitor is located. The energy storing circuit 6 is connected to a logic and memory circuit 7 for feeding energy to and activating the logic and memory circuit 7 which upon activation controls the change-over of the switch 3 between closed and open connection. In the memory part of the logic and memory circuit 7, the information about the type of ammunition for which the device is intended is stored. The memory part can be programmed for this purpose by strapping or programming for, for example, a value corresponding to the number of to or fro change-overs which the switch 3 will carry out upon external initiation of the device. On the basis of the information stored in the memory part, the logic part in the logic and memory circuit 7 controls the course of the switch-over of the switch 3. When a current is connected to the terminals 8, 9, the device responds with a change in resistance which can be detected at terminals 8, 9. The detection is described in greater detail below with respect to FIG. 5 and 6. A means for activating ammunition such as squib or fuse head 10 for which ammunition the device for indicating the type of ammunition is intended, is shown with separate connecting terminals 11, 12 for separate connection to a release unit in the release system. A dot-dashed line 13 marks the boundary between the release unit 24 and the ammunition unit 14 in a release system.

The embodiment described above with reference to FIG. 1 requires four connecting terminals 8, 9, 11, 12 between an ammunition unit 14 and a release unit 24. FIG. 2 shows an embodiment which only requires two connecting terminals. According to this embodiment, the so-called "squib" or fuse head 10 is coupled to the same connecting points as the device for indicating the type of ammunition. The remaining parts of the device can be constructed in accordance with that described above with reference to FIG. 1.

By coupling in a relatively weak current at terminals 8, 9, the squib 10 can be operationally tested, on the one hand, and the information on the type of ammunition can be obtained, on the other hand. When a stronger current is coupled in, the squib is heated up to an explosion-triggering level and the ammunition is released.

A proposed embodiment of an ammunition unit is shown in FIG. 3*a* and 3*b*. FIG. 3*a* shows a vertical section through the ammunition unit and FIG. 3*b* shows a bottom view. The ammunition charge 15 is accommodated in a cartridge 16 with circular cylindrical shape. The cartridge bottom 17 is constructed of a plane plate provided with a number of contact elements in the form of contact rings 18, 19, 20 and a central contact surface 21. In the space nearest to the cartridge bottom, on the one hand a so-called squib 10 and on the other hand the device 22 indicating the type of ammunition are mounted. The embodiment described with reference to FIG. 1 is connected to four contact elements while the embodiment according to FIG. 2 is connected to two contact elements. If a common ground is allowed, the number of connected contact elements can be reduced to three in the embodiment according to FIG. 1.

A release system is shown in a basic diagram form in FIG. 4. From a control unit 23, a number of release units 24, 25 comprising magazines, 34, 35 for ammunition units are controlled. There is an operating unit 26 and a display unit 27 for communication with an operator. The release system contains a measuring circuit 28 (shown in detail in FIG. 5) which is included as part of the control unit 23 as marked by a dashed box in FIG. 4 or can constitute a wholly or partly separated unit.

Figure 5:
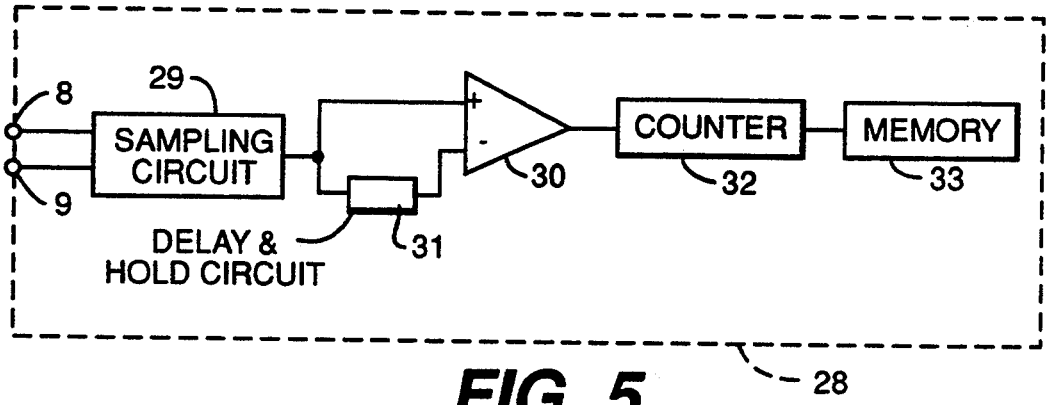
FIG. 5 shows a measuring circuit used in the release system.
Figure 6:
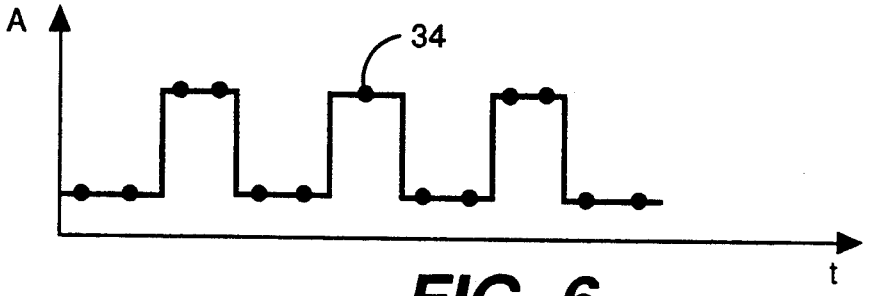
FIG. 6 illustrates how the measuring circuit senses incoming signals.

According to FIG. 5, a sampling circuit 29 senses a signal present between connecting terminals 8 and 9. The sampled signal is supplied to a comparator 30 partly directly and partly via a delay and hold circuit 31 which delays and holds a sampled signal for one sampling interval. When the input signals of the comparator 30 deviate to a certain level, the comparator outputs a pulse which is counted in the counter 32. After completed counting, that is a stable position for a relatively long time, the type of ammunition can be unambiguously identified for the ammunition unit in question. The positions of the different ammunition types are stored in a memory 33 in a table form from which the different types of ammunition can be unambiguously identified on the basis of the counting results supplied by the counter 32. FIG. 6 shows an example of how the input signal of the measuring circuit 28, that is how a signal detected between connecting terminals 8 and 9, can look as a function of time t. The Y axis represents an electrical quantity A which is based on impedance, that is resistance, capacitance or inductance. The signal is sampled at equal intervals at least at the rate described by the sampling theorem. In FIG. 6, solid dots 34 mark examples of sampling times.

The invention is not limited to the embodiments shown in the above examples but can also be subjected to modifications within the scope of the claims following hereinafter and the concept of the invention. For example, there is the possibility of modifying the configuration of the device indicating the type of ammunition or of the measuring circuit within wide limits without deviating from the concept of the invention.

We claim:

1. A device for indicating the type of ammunition provided in or on the ammunition unit comprising:

a) a distinguishable specific identification means allocated for each type of ammunition and made up of electronic means with different electrical characteristics depending on the type of ammunition, said electronic means including a status-changing element which can change between at least two statuses having different electrical characteristics; and b) a control circuit for controlling change-over of said status-changing element between said at least two statuses having different electrical characteristics, the process of the status changes controlled by the control circuit being indicative of the type of ammunition contained in the ammunition unit.

2. A device according to claim 1, wherein the type of ammunition is determined by detecting means based on the number of change-overs from a first status to a second status following initiation of the status-changing element.

3. A device according to claim 1 wherein the different electrical characteristics of the status changing element are produced by changing impedance.

4. A device according to claim 1, wherein the status changes are initiated by external electrical input from controlling means.

5. A device according to claim 4, wherein the type of ammunition is determined based on the number of status change-overs following initiation of the status-changing element.

6. An ammunition unit comprising:

a cartridge;

at least one ammunition charge in said cartridge, means for activating release of the ammunition charge in response to an activating signal and a device for indicating the type of ammunition charge which is contained in the ammunition unit, said device including:

a) a distinguishable specific identification means allocated for each type of ammunition and made up of electronic means with different electrical characteristics depending on the type of ammunition, said electronic means including a status-changing element which can change between at least two statuses having different electrical characteristics; and b) a control circuit for controlling change-over of said status-changing element between said at least two statuses having different electrical characteristics, the process of the status changes controlled by the control circuit being indicative of the type of ammunition contained in the ammunition unit.

7. An ammunition unit according to claim 6 wherein said ammunition type indicating device and said means for activating release of ammunition charge have common contact terminals for connection to common power source.

8. A release system comprising:

at least one release unit having a magazine for ammunition units, each ammunition unit being provided with a device for indicating the type of ammunition charge contained in the ammunition unit, the device including a distinguishable specific indication means for associated ammunition type and including a status-changing element with at least two statuses having different electrical characteristics and a control unit for providing electrical input signals to said ammunition unit and means for detecting status changes of said status-changing element of said indicating device and for determining the type of ammunition based on the status changes.

9. A release system according to claim 8 wherein said ammunition unit also includes therein charge activating means having common terminals with said ammunition type indicating device and being controlled by said control unit.

10. A release system according to claim 8 wherein said detecting means includes a sampling circuit and a comparator, said comparator receiving signal samples from said circuit, and based on two samples following one another, identifying status change-overs.

11. A release system according to claim 10 wherein said detecting means is incorporated into said control unit.

* * * * *